US008070886B2

(12) United States Patent
Inoue et al.

(10) Patent No.: US 8,070,886 B2
(45) Date of Patent: Dec. 6, 2011

(54) TREATMENT SOLUTION FOR FORMING OF BLACK TRIVALENT CHROMIUM CHEMICAL COATING ON ZINC OR ZINC ALLOY AND METHOD OF FORMING BLACK TRIVALENT CHROMIUM CHEMICAL COATING ON ZINC OR ZINC ALLOY

(75) Inventors: Manabu Inoue, Tokyo (JP); Satoshi Yuasa, Tokyo (JP)

(73) Assignee: Dipsol Chemicals Co., Ltd., Tokyo (JP)

( * ) Notice: Subject to any disclaimer, the term of this patent is extended or adjusted under 35 U.S.C. 154(b) by 419 days.

(21) Appl. No.: 12/192,840

(22) Filed: Aug. 15, 2008

(65) Prior Publication Data

US 2009/0050238 A1 Feb. 26, 2009

Related U.S. Application Data

(63) Continuation of application No. PCT/JP2007/052980, filed on Feb. 19, 2007.

(30) Foreign Application Priority Data

Feb. 17, 2006 (JP) ..... 2006-041178

(51) Int. Cl.
*C23C 22/30* (2006.01)
*C23C 22/48* (2006.01)

(52) U.S. Cl. ..... 148/267; 148/264; 148/266; 148/271; 148/274; 106/14.05; 106/14.11; 106/14.44

(58) Field of Classification Search ..... 148/264–268, 148/271, 274; 106/14.05, 14.11, 14.44
See application file for complete search history.

(56) References Cited

U.S. PATENT DOCUMENTS

| | | | |
|---|---|---|---|
| 4,263,059 | A | 4/1981 | Guhde et al. |
| 4,578,122 | A | 3/1986 | Crotty |
| 5,368,655 | A | 11/1994 | Klos |
| 5,407,749 | A | 4/1995 | Bishop |
| 5,415,702 | A | 5/1995 | Bishop et al. |

FOREIGN PATENT DOCUMENTS

| | | | |
|---|---|---|---|
| EP | 1 484 432 | A1 | 12/2004 |
| JP | 10-183364 | A | 7/1998 |
| JP | 2000-054157 | A | 2/2000 |

(Continued)

OTHER PUBLICATIONS

International Search Report for PCT/JP2007/052980.

(Continued)

*Primary Examiner* — Roy King
*Assistant Examiner* — Lois Zheng
(74) *Attorney, Agent, or Firm* — Hoffmann & Baron, LLP

(57) ABSTRACT

A treatment solution that is used to form a chemical coating of trivalent chromium free of hexavalent chromium having uniform black appearance and good corrosion resistance on the surface of zinc or zinc alloy and that attains prolongation of treatment bath lifetime; and a method of forming a black trivalent chromium chemical coating on the surface of zinc or zinc alloy. There is provided a treatment solution for forming of a black trivalent chromium chemical coating on zinc or zinc alloy, comprising trivalent chromium ions, a chelating agent capable of forming a water-soluble complex with trivalent chromium, zinc ions, a sulfur compound and phosphite ions.

6 Claims, 1 Drawing Sheet

FOREIGN PATENT DOCUMENTS

| | | | | |
|---|---|---|---|---|
| JP | 2000-509434 | A | | 7/2000 |
| JP | 2003-213446 | A | | 7/2003 |
| JP | 2003-268562 | A | | 9/2003 |
| JP | 2005-126797 | | * | 5/2005 |
| JP | 2005-126797 | A | | 5/2005 |
| JP | 2005-187925 | A | | 7/2005 |
| JP | 2005-206872 | | * | 8/2005 |
| JP | 2005-206872 | A | | 8/2005 |
| WO | WO 97/40208 | A1 | | 10/1997 |

OTHER PUBLICATIONS

European Search Report for Application No. 07714506.8 dated Jun. 29, 2011.

* cited by examiner

TREATMENT SOLUTION FOR FORMING OF BLACK TRIVALENT CHROMIUM CHEMICAL COATING ON ZINC OR ZINC ALLOY AND METHOD OF FORMING BLACK TRIVALENT CHROMIUM CHEMICAL COATING ON ZINC OR ZINC ALLOY

CROSS-REFERENCE TO RELATED APPLICATIONS

This application is a Continuation of International Application No. PCT/JP2007/052980, filed Feb. 19, 2007, which claims the benefit of Japanese Application No. 2006-041178, filed Feb. 17, 2006, the contents of both of which are incorporated by reference herein in their entirety.

FIELD OF THE INVENTION

The present invention relates to a treatment solution for forming, on the surface of zinc or zinc alloy, a Hexavalent chromium-free black trivalent chromium chemical conversion coating film with a uniform black and bright appearance and a good corrosion resistance, and a method for forming the black trivalent chromium chemical conversion coating film.

BACKGROUND OF THE INVENTION

Recently, a method using zinc or zinc alloy plating has been widely employed as a method for inhibition corrosion of the surface of a metal. However, plating by itself will not provide a sufficient corrosion resistance, and thus a chromic acid treatment after plating, that is, a so-called chromate treatment, has been widely employed in industry. On the other hand, it has been pointed out that hexavalent chromium harms human bodies and the environment, and, as a result, moves to regulate the use of hexavalent chromium have gained momentum. An alternative to a coating film formed with hexavalent chromium is a rust preventive coating film in which trivalent chromium is used. For example, Patent Article 1 discloses a treatment method using a mixture of trivalent chromium, a fluoride, an organic acid, an inorganic acid and a metal salt such as cobalt sulfate. However, this bath has environmental problems since a fluoride is used in the bath. Meanwhile, Patent Article 2 proposes hexavalent chromium-free rustproofing in which a phosphoric acid, a salt of a metal such as Mo, $Cr^{3+}$ or Ti, and an oxidant are used. However, in this method there is still a possibility that trivalent chromium will be oxidized into hexavalent chromium, because of using a large amount of an oxidant.

Patent Article 3 proposes a chemical conversion treatment in which phosphorus, a metal such as Mo, and trivalent chromium are used but no fluoride is used. However, as a result of our confirmation test, it was found that a satisfactory corrosion resistance could not be reproduced. In addition, Patent Article 4 discloses a treatment method in which 5 to 100 g/L of trivalent chromium, nitrate, an organic acid, and a salt of a metal such as cobalt are used. Since in his method concentrations of chromium and the like are high and the treatment is carried out at an elevated temperature, this method has the advantage that a thick film, and accordingly a good corrosion resistance can be obtained, but the disadvantage that a stable corrosion resistance cannot be obtained because of difficulty in forming a stable and dense film. In addition, the method is also disadvantageous in wastewater treatment since the treatment bath contains chromium in high concentration and a large amount of an organic acid is also used therein. In addition, as to the appearance of the film, only colorless and interference-color appearance can be obtained. In this connection, as to formation of a black trivalent chromium chemical conversion coating film on zinc-nickel (Ni % in the film is 8% or more) or zinc-iron, Patent Article 5 discloses a treatment method with an aqueous acidic solution containing a phosphorus acid compound and trivalent chromium. Meanwhile, as to formation of an interference-color trivalent chromium chemical conversion coating film on zinc-nickel (Ni % in the film is 8% or more), Patent Article 6 discloses a treatment method with an aqueous acidic solution likewise containing a phosphorus compound, trivalent chromium, and additionally halate ions. However, the Ni codeposition rate of much of actually produced zinc-nickel alloy plating falls below 8%, and thus these method have practical problems in obtaining a black appearance. Meanwhile, regarding zinc-iron alloy plating, a sufficient corrosion resistance has not been provided. As other methods, Patent Article 7 proposes a treatment method using trivalent chromium in a low concentration, an organic acid and a salt of a metal such as nickel, while Patent Article 8 proposes a treatment method using trivalent chromium in a low concentration and an organic acid. However, these methods provide a less sufficient corrosion resistance than conventional chromate.

The treatment solution disclosed in Patent Article 9 developed by the present inventors provide a good black appearance and a good corrosion resistance more than comparable to chromate using hexavalent chromium. In addition, the present inventors evaluate that the treatment solution in Patent Article 10 or Patent Article 11 provides a poorer corrosion resistance but a better black appearance than conventional black chromate. However, these chemical conversion treatment solutions each have a problem of having a short treatment bath life since the treatment solution provides a reduced black appearance as zinc ions become accumulated in the treatment solution by being dissolved from zinc or zinc alloy on the surface of the treated substrate through chemical conversion treatment of the zinc or zinc alloy.

Patent Article 1: Japanese Examined Patent Application Publication No. Sho 63-015991;
Patent Article 2: Japanese Patent Application Publication No. Hei 10-183364;
Patent Article 3: Japanese Patent Application Publication No. 2000-54157;
Patent Article 4: Japanese Patent Application Publication No. 2000-509434;
Patent Article 5: U.S. Pat. No. 5,415,702;
Patent Article 6: U.S. Pat. No. 5,407,749;
Patent Article 7: U.S. Pat. No. 4,578,122;
Patent Article 8: U.S. Pat. No. 5,368,655;
Patent Article 9: Japanese Patent Application Publication No. 2003-268562;
Patent Article 10: Japanese Patent Application Publication No. 2005-187925; and
Patent Article 11: Japanese Patent Application Publication No. 2005-206872.

SUMMARY OF THE INVENTION

An object of the present invention is to provide: a treatment solution for forming, on the surface of zinc or zinc alloy, a hexavalent chromium-free trivalent chromium chemical conversion coating film with a uniform black appearance and a good corrosion resistance, the treatment solution having a longer treatment bath life; and a method for forming the black trivalent chromium chemical conversion coating film.

To solve the above problems, the present inventors have made a thorough examination and found that performance of the treatment bath can be maintained stable over a long period by employing a chemical conversion treatment liquid having a certain composition and by maintaining the sulfur compound concentration in the treatment solution within a certain concentration range determined depending on the trivalent chromium ion concentration and the zinc ion concentration accumulated through chemical conversion treatment. As a result, the present inventors have completed the present invention. Specifically, the present invention provides a treatment solution for forming a black trivalent chromium chemical conversion coating film on zinc or zinc alloy, the solution comprising a trivalent chromium ion; a chelating agent capable of forming a water soluble complex with the trivalent chromium ion; a zinc ion; a sulfur compound; and a phosphite ion.

Moreover, the present invention also provides a method for forming a black trivalent chromium chemical conversion coating film on zinc or zinc alloy by using the treatment solution, the method comprising the step of setting a zinc ion concentration in the treatment solution at an initial stage (in an initial bath preparation) within the range of 0.002 to 0.15 mol/L, wherein the zinc ion concentration is controlled so as not to be out of the range of 0.002 to 0.15 mol/L.

Moreover, the present invention also provides a method for forming a black trivalent chromium chemical conversion coating film on zinc or zinc alloy, the method comprising the step of performing a chemical conversion treatment on zinc or zinc alloy by using the treatment solution with the solution kept at a temperature of 10 to 60° C.

Furthermore, the present invention also provides a metal coated with zinc or zinc alloy having a black trivalent chromium chemical conversion coating film formed by performing a chemical conversion treatment on the zinc or zinc alloy with the treatment solution.

The present invention makes it possible to form a hexavalent chromium-free black trivalent chromium chemical conversion coating film having excellent black appearance and corrosion resistance, and having uniform and stable black and bright appearance and corrosion resistance. Moreover, the chemical conversion treatment solution according to the present invention is a solution for a chemical conversion treatment bath achieving low reduction in blackness, having a longer life and containing trivalent chromium in a low concentration to be advantageous in wastewater treatment and thus has a good cost performance.

DETAILED DESCRIPTION OF THE INVENTION

Figure 1:
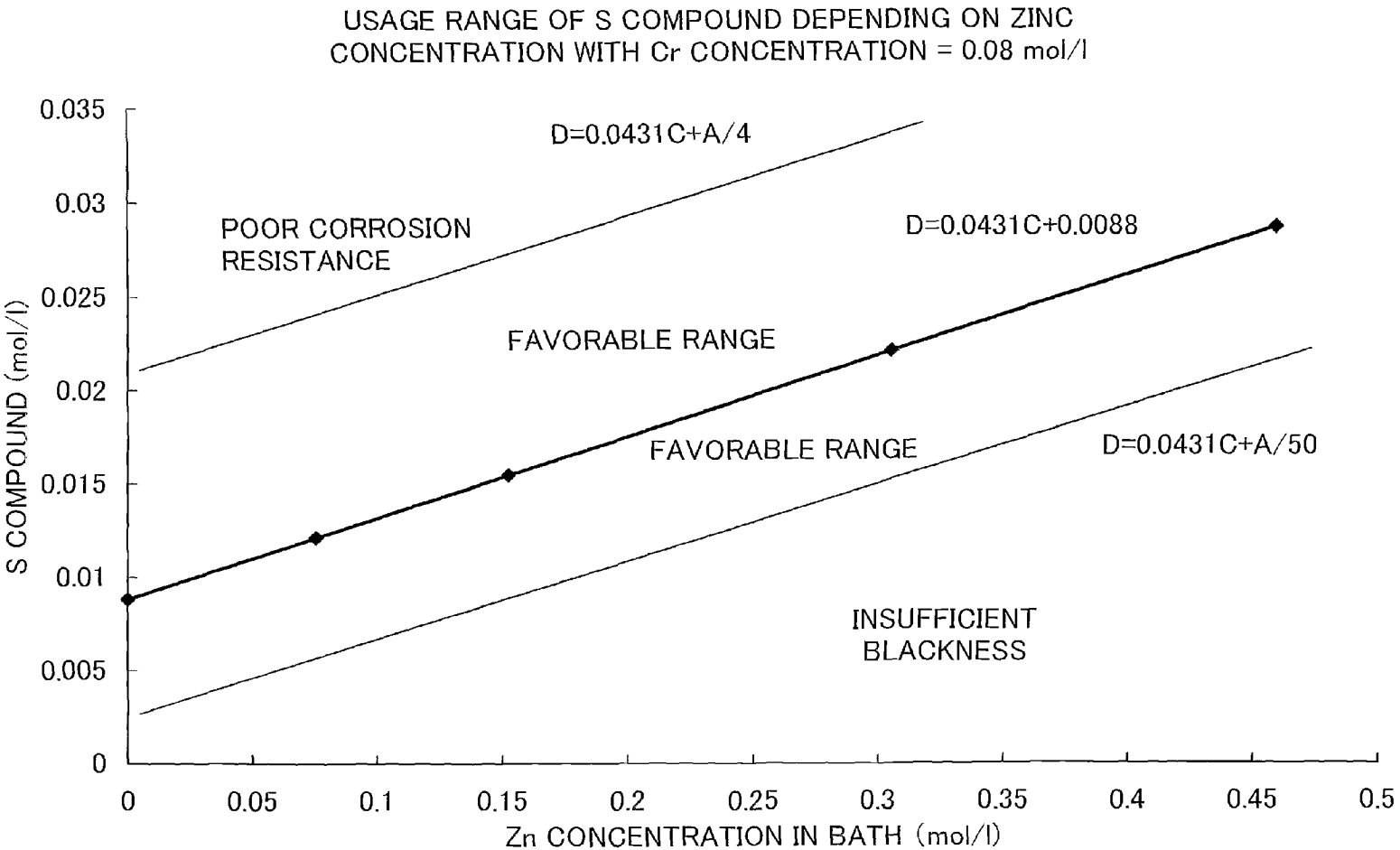
FIG. 1 shows the range of the ratio of the sulfur compound concentration D to tine zinc concentration in the case where the trivalent chromium concentration in the treatment solution is 0.08 mol/L.

The substrate used in the present invention may be made of any of the following materials: various metals such as iron, nickel and copper; alloys thereof; and metals and alloys such as aluminum, which have been subjected to zincate conversion treatment, and may have any of various shapes such as plate-like, rectangular, column-like, cylindrical and spherical shapes.

The above substrate is plated with zinc or a zinc alloy by the usual method. The zinc plating may be deposited on the substrate using either of the following baths: an acidic/neutral bath such as a sulfuric acid bath, a borofluoride bath, a potassium chloride bath, a sodium chloride bath or an ammonium chloride-potassium chloride bath; or an alkaline bath such as a cyanide bath, a zincate bath or a pyrophoric acid bath, but particularly, a zincate bath is preferable. The zinc alloy plating may be performed using either an ammonium chloride bath or an alkaline bath such as an organic chelate bath.

In addition, the zinc alloy plating may be zinc-iron alloy plating, zinc-nickel alloy plating, zinc-cobalt alloy plating or tin-zinc alloy plating, but zinc-iron alloy plating is preferable. The zinc or zinc alloy plating may be deposited on a substrate in any thickness, but preferably in the thickness of 1 μm or more, and more preferably in the thickness of 5 to 25 μm.

In the present invention, after the zinc or zinc alloy plating is deposited on a substrate according to the above method, the plated substrate is appropriately pretreated by, for example, being washed with water and optionally activated by a nitric acid, as needed. Thereafter, the zinc or zinc alloy plating is subjected to chemical conversion treatment by a dipping treatment or the like using a treatment solution for forming a black trivalent chromium chemical conversion coating film according to the present invention.

The treatment solution for forming a black trivalent chromium chemical conversion coating film on a zinc or zinc alloy according to the present invention contains: trivalent chromium ions; a chelating agent capable of forming a water soluble complex with trivalent chromium; zinc ions; a sulfur compound; and phosphite ions.

In the treatment solution of the present invention, any chromium compound containing trivalent chromium ions may be used as a source of trivalent chromium ions. However, the source should preferably be a trivalent chromium salt such as chromium chloride, chromium sulfate, chromium nitrate, chromium phosphate or chromium acetate, or, alternatively, trivalent chromium ions can be obtained by the reduction of hexavalent chromium ions of chromic acid, dichromic acid and the like with a reducing agent. The especially preferable source of trivalent chromium ions is chromium nitrate. One of the above sources of trivalent chromium ions or any combination of at least two of them may be used. The concentration of trivalent chromium ions in the treatment solution is not limited from the viewpoint of its performance, but should preferably be as low as possible from the viewpoint of the wastewater treatment.

Therefore, the concentration of trivalent chromium ions in the treatment solution should preferably be in the range of 0.01 to 0.3 (mol/L) [3.5 to 15 (g/L)] and more preferably 0.02 to 0.2 (mol/L) [1 to 10 (g/L)], in consideration of the corrosion resistance and the like. In the present invention, the use of trivalent chromium in such a low concentration is advantageous from the viewpoint of the wastewater treatment and the cost.

The chelating agent capable of forming a water soluble complex with the trivalent chromium ions used in the treatment solution according to the present invention may be: a hydroxycarboxylic acid such as tartaric acid or malic acid; any of monocarboxylic acids other than formic acid and acetic acid, a polyvalent carboxylic acid such as a dicarboxylic acid or a tricarboxylic acid, for example oxalic acid, malonic acid, succinic acid, citric acid or adipic acid or an aminocarboxylic acid such as glysinic acid. Note that, among monocarboxylic acids, formic acid and acetic acid are inappropriate as the chelating agent, but may each be added to the treatment solution according to the present invention as needed since these acids each have an effect of promoting blackening as a buffering agent. As the chelating agent, one of the aforementioned acids and salts thereof (e.g. salts of sodium, potassium, ammonia and the like) or any combination of at least two of them may be used. The concentration of the chelating agent in the treatment solution is not limited, but should preferably be in the range of 1 to 40 g/L, and more preferably be in the range of 5 to 35 g/L in total. The molar ratio of the chelating agent to the trivalent chromium ions in the treatment solution according to the present invention [chelating agent concentration (mol/L)/trivalent chromium ion concentration (mol/L)] should preferably be in the range of 0.2 to 4, and more preferably be in the range of 1 to 2. In addition, the method for mixing the trivalent chromium compound and the chelating agent is not particularly limited, but the trivalent chromium compound and the chelating agent may be used after being mixed and heated at a temperature of 60° C. or more in advance so as to facilitate forming a complex, for example.

The sulfur compound used in the treatment solution according to this invention may be either an inorganic sulfur compound or an organic sulfur compound, but should preferably be an organic sulfur compound. Examples of inorganic sulfur compounds include compounds such as sodium sulfide, potassium sulfide, ammonium sulfide, calcium sulfide, sodium thiosulfate and sodium hydrogensulfide. Specific examples of organic sulfur compounds include: thioureas such as thiourea, allylthiourea, ethylene thiourea, diethylthiourea, diphenylthiourea, tolylthiourea, guanylthiourea and acetylthiourea; mercaptans such as mercaptoethanol, mercantohypoxanthine, mercaptobenzimidazole and mercaptobenzthiazole; thiocyanic acid and salts thereof; amino compounds such as aminothiazole; thiocarboxylic acids such as thioformic acid, thioacetic acid, thiomalic acid, thioglycolic acid, thiodiglycolic acid, thiocarbamic acid and thiosalicyclic acid; salts of these thiocarboxylic acids, dithiocarboxylic acids such as dithioformic acid, dithioacetic acid, dithioglycolic acid, dithiodiqlycolic acid and dithiocarbamic acid; and salts of these thiocarboxylic acids. Among these organic sulfur compounds, thioureas, thiocarboxylic acids, dithiocarboxylic acids and salts thereof are preferable, and particularly, thiourea, thioacetic acid, thioglycolic acid, thiomalic acid, thiomaleic acid, dithioglycolic acid, sodium salts thereof and ammonium salts thereof are more preferable. The zinc ion concentration C (mol/L), the trivalent chromium ion concentration A (mol/L), and the sulfur compound concentration D (mol/L) in the treatment solution according to this invention are the range represented by the following Expression (1), should preferably be in the range represented by the following Expression (2), and should more preferably be In the range represented by the following Expression (3).

$$0.0431C+A/4 \geqq D \geqq 0.0431C+A/50 \quad \text{Expression (1)}$$

$$0.0431C+A/5 \geqq D \geqq 0.0431C+A/30 \quad \text{Expression (2)}$$

$$0.0431C+A/6 \geqq D \geqq 0.0431C+A/20 \quad \text{Expression (3)}$$

It is not preferred that the sulfur compound concentration D in the treatment solution exceeds the range represented by Expression (1) since this condition allows the chemical conversion coating film to have insufficient corrosion resistance. Meanwhile, it is not preferred that the sulfur compound concentration D in the treatment solution fall below this range since this condition will make the blackness of the chemical conversion coating film insufficient.

The zinc ion concentration in the treatment solution according to this invention is in the range of 0.002 to 0.45 (mol/L), and, at an initial stage (in an initial bath preparation), in the range of 0.002 to 0.15 (mol/L). Existence of zinc ions in the treatment solution according to this invention at an initial stage (in an initial bath preparation) improves the corrosion resistance of the chemical conversion coating film. Specifically, the zinc ion concentration at an initial stage (in an initial bath preparation) is in the range of 0.002 to 0.15 (mol/L), should preferably be in the range of 0.015 to 0.1 (mol/L), and should more preferably be in the range of 0.05 to 0.1 (mol/L) Then, the zinc ion concentration increases with the progress of the chemical conversion treatment. The zinc ion concentration in the treatment bath during treatment is in the range of 0.002 to 0.45 (mol/L), should preferably be in the range of 0.015 to 0.3 (mol/L), and should more preferably be in the range of 0.05 to 0.25 (mol/L). A too high zinc ion concentration in the treatment bath is not preferable since this causes the chemical conversion coating film to have insufficient corrosion resistance and blackness. The method for measuring zinc ions in order to control the zinc ion concentration in the chemical conversion treatment is not particularly limited, but the zinc ion concentration may be accurately controlled by a known method such as titrimetric analysis, ion plasma spectrometry or atomic absorption spectrometry. The trivalent chromium ion concentration may also be controlled by a similar method.

The reason why the chemical conversion treatment liquid according to the present invention allows formation of a hexavalent chromium-free trivalent chromium chemical conversion coating film with a uniform black appearance and a good corrosion resistance, a long-lasting property thereof and an extended bath life is not clear. However, the reason can be assumed to be as follows.

Firstly, hydrogen ions cause zinc in the surface of the substrate metal to dissolve into the treatment liquid, and this increases the hydrogen ion concentration on the surface of the metal to produce a chromium hydroxide thereon. Meanwhile, the reaction of trivalent chromium ions and a sulfur compound produces a black metal sulfide thereon. Then, these metal compounds thus produced form a film, and thereby a black chemical conversion coating film develops. In this reaction, an increase in the zinc concentration in the treatment bath might suppresses the dissolution of the zinc, thus slowing down the formation of a chemical conversion coating, and making it impossible to obtain a good black film. Accordingly, by maintaining the molar ratio of the zinc ion concentration to the sulfur compound within a certain low range, blackening reaction of the trivalent chromium ions and the sulfur compound will progress speedily so that a good film will be obtained even if the zinc concentration increases. Specifically, the molar ratio of the zinc ion concentration to the sulfur compound can be maintained within a certain low range by a method of adding a sulfur compound within a certain range in accordance with a certain concentration of trivalent chromium in the treatment bath and the concentration of zinc ions in the treatment bath increasing through the chemical conversion treatment. Expression (1) proposed in the present invention is an empirical formula obtained as above, and FIG. 1 shows the range of the ratio of the sulfur compound concentration D to the zinc concentration in the case where the trivalent chromium concentration in the treatment solution is 0.08 mol/L.

The additional existence of a chelating agent capable of forming a water soluble complex with trivalent chromium in the above treatment solution will likely suppress the deposition rate of a chromium hydroxide and thus make a film denser. Moreover, the additional existence of the phosphite ions up to a certain concentration will produce a buffering effect, and thereby gives the film not only a certain thickness and good adhesion, but also improved uniformity and corrosion resistance. A specific example of a method of adding a sulfur compound in accordance with the increase in the zinc ion concentration caused by the chemical conversion treatment in the treatment solution according to this invention may be a method of adding a supplemental fluid. Such a supplemental fluid needs only to contain a sulfur compound and the composition of the solution is not particularly limited. However, the supplemental fluid may be, for example, an aqueous solution containing:

| | |
|---|---|
| sodium phosphite pentahydrate | 5 g/L |
| chromium nitrate | 40 g/L |
| sulfur compound | 8 g/L. |

In addition, timing of an addition or an amount of such a supplemental fluid is not particularly limited as long as the zinc concentration can fall within the predetermined range, and thus the supplemental fluid may be added Intermittently or continuously as needed.

A source of phosphite ions in the treatment solution according to this invention may be a phosphorous acid or a phosphite such as sodium phosphite or potassium phosphite, for example. The phosphite ion concentration in the treatment bath is in the range of 0.01 to 0.6 (mol/L), should preferably be in the range of 0.02 to 0.4 (mol/L), and should more preferably be in the range of 0.03 to 0.2 (mol/L).

The treatment solution according to this invention may also contain metal ions other than trivalent chromium ions. Such metal ions may be monovalent to hexavalent metal ions, but preferably metal ions are ions of cobalt, nickel, silicon, iron, titanium, zirconium, tungsten, molybdenum, strontium, niobium, tantalum, manganese, calcium, magnesium, aluminum and the like, and more preferably metal ions are cobalt ions, nickel ions and iron ions. The treatment solution may contain one or more kinds of metal ions selected from these metal ions. Such metal ions may be contained in the treatment solution at any concentration, but should preferably be contained as cations at a concentration in the range of 0.1 to 50 g/L, and more preferably in the range of 0.5 to 20 g/L in total. A source of such metal ions may be chlorides, nitrates, sulfates, acetates, oxoates or the like of the metal ions.

In addition, a good black appearance can be obtained on the zinc or zinc alloy plating by adding, into the treatment solution according to the present invention, one or more kinds of inorganic acid ions selected from the group consisting of ions of any of phosphorus oxoacids other than phosphorous acid, chloride ions, nitrate ions and sulfate ions. A source of phosphorus oxoacid ions may be a phosphorus oxoacid such as phosphoric acid or hypophosphorous acid, or a salt thereof. A source of chloride ions may be hydrochloric acid or a chloride salt such as sodium chloride or potassium chloride. A source of sulfate ions may be a sulfurous oxoacid such as sulfuric acid or sulfurous acid, or a salt thereof. A source of nitrate ions may be nitric acid, nitrous acid or the like, or a salt thereof. In the treatment solution according to the present invention, one of the above acids and salts thereof or a mixture of two or more of them can also be used. The concentration of the inorganic acid ions in the treatment solution is not limited, but should preferably be in the range of 1 to 150 g/L, and more preferably be in the range of 5 to 80 g/L in total.

The pH of the treatment solution according to the present invention should preferably be 0.5 to 4, more preferably 1 to 3. The pH can be adjusted to this range by using the above inorganic acid, an organic acid, an alkaline hydroxide, ammonia water or the like.

A black trivalent chromium chemical conversion coating film is formed on the zinc or zinc alloy plating through the chemical conversion treatment of the zinc or zinc alloy plating using the above treatment solution according to the present invention by, for example, immersing the zinc or zinc alloy plating into the treatment solution. A temperature or the treatment solution should preferably be in the range of 10 to 60° C. and more preferably be in the range of 20 to 50° C. An immersing time into the treatment solution should preferably be in the range of 5 to 600 seconds and more preferably be in the range of 20 to 120 seconds. In this connection, the zinc or zinc alloy plating may be immersed into a dilute nitric acid solution in order to activate the surface of the zinc or zinc alloy plating, before the trivalent chromium chemical conversion treatment. The conditions and treatment operations other than those described above may follow the conventional hexavalent chromium treatment method. In addition, after the trivalent chromium chemical conversion treatment according to the present invention, the zinc or zinc alloy may be washed with water, immersed in a solution containing chromic phosphate or a finishing liquid containing chromic phosphate and zinc and/or a resin, and dried without being washed with water. This makes it possible to form the black film with still better corrosion resistance.

Meanwhile, overcoating the trivalent chromium chemical conversion coating film can improve the corrosion resistance thereof, and thus is a highly effective means for achieving longer-lasting corrosion resistance. For example, the zinc or zinc alloy plating may be firstly subjected to the above trivalent chromate treatment, then washed with water, then immersed into an overcoating solution or subjected to an electrolytic treatment therein, and thereafter dried. Alternatively, the zinc or zinc alloy plating may be dried after the trivalent chromate treatment, and thereafter further immersed into an overcoating solution or subjected to an electrolytic treatment therein, and then dried. Here, as the overcoating, as well as an inorganic film made of silicates, phosphates or the like, an organic film made of polyethylene, polyvinyl chloride, polystyrene, polypropylene, metacrylate resin, polycarbonate, polyamide, polyacetal, fluorine resin, urea resin, phenolic resin, unsaturated polyester resin, polyurethane, alkyd resin, epoxy resin, melamine resin or the like may be effectively used.

As the overcoating solution for overcoating such a film DIPCOAT W or CC445 available from Dipsol Chemicals Co., Ltd. or the like may be used. The thickness of the overcoating may be any value, but should preferably be 0.1 to 30 μm.

EXAMPLES

Examples 1 to 4 and Comparative Examples 1 to 5

Tests were conducted using aqueous solutions containing trivalent chromium ions at the concentration (A) of 0.08 mol/L with the following components added. (Note that the source of trivalent chromium ions was chromium nitrate, the source of zinc ions was zinc nitrate, the sulfur compound was dithiodiglycolic acid, the source of phosphite ions was sodium phosphite, and the chelating agent was oxalic acid.) The pH of the treatment solution was 1.9, and the treatment was performed with air agitation under the condition of a temperature of 25° C. and time of 60 seconds. Drying was performed at 80° C. for 20 minutes. As the plated panel, a steel plate plated with zincate zinc (NZ-98) in a thickness of 8 μm was used. The test results are shown in Table 1.

TABLE 1

| Test. No. | Zinc ion concentration (C) (mol/L) (g/L) | Sulfur compound concentration (D) (mol/L) | Phosphite ion concentration (mol/L) | Chelating agent concentration (mol/L) | Appearance | Corrosion resistance (Hr) | 0.0431C + A/4 | 0.0431C + A/50 |
|---|---|---|---|---|---|---|---|---|
| Example 1 | 0.076<br>5 | 0.01 | 0.05 | 0.1 | Uniform Black | 120 | 0.023 | 0.0049 |
| Example 2 | 0.15<br>10 | 0.015 | 0.1 | 0.1 | Uniform Black | 120 | 0.026 | 0.0081 |
| Example 3 | 0.306<br>20 | 0.02 | 0.15 | 0.1 | Uniform Black | 120 | 0.033 | 0.015 |
| Example 4 | 0.076<br>5 | 0.01 | 0.15 | 0.1 | Uniform Black | 144 | 0.023 | 0.0049 |
| Comparative Example 1 | 0.076<br>5 | 0.01 | 0 | 0 | Light black | 24 | 0.023 | 0.0049 |
| Comparative Example 2 | 0.076<br>5 | 0.01 | 0.05 | 0 | Non uniform interference color | 24 | 0.023 | 0.0049 |
| Comparative Example 3 | 0 | 0.01 | 0.05 | 0.1 | Uniform Black | 72 | 0.02 | 0.0016 |
| Comparative Example 4 | 0.076<br>5 | 0.01 | 0 | 0.1 | Uniform Black | 24 | 0.023 | 0.0049 |
| Comparative Example 5 | 0.306<br>20 | 0.01 | 0.15 | 0.1 | Non uniform interference color | 120 | 0.033 | 0.015 |
| Comparative Example 6 | 0.306<br>20 | 0.035 | 0.15 | 0.1 | black | 24 | 0.033 | 0.015 |

Examples 5 to 8

Tests were conducted using aqueous solutions containing trivalent chromium ions at the concentration (A) of 0.08 mol/L with the following components added. (Note that the source of trivalent chromium ions was chromium nitrate, the source of zinc ions was zinc nitrate, the sulfur compound was dithiodiglycolic acid, the source of phosphite ions was sodium phosphite, and the chelating agent was oxalic acid.) The pH of the treatment solution was 1.9 and the treatment was performed with air agitation under the condition of a temperature of 25° C. and time of 60 seconds. In addition after the chemical conversion treatments, the plated panel was immersed in a finishing liquid containing chromic phosphate and zinc, Dipsol ZTB-118 (20 mL/L aqueous solution) at 50° C. for 10 seconds, and then dried without being washed with water. Drying was performed at 80° C. for 20 minutes. As the plated panel, a steel plate plated with zincate zinc (NZ-98) in a thickness of 8 μm was used. The test results are shown in Table 2.

TABLE 2

| Test No. | Zinc ion concentration (C) (mol/L) (g/L) | Sulfur compound concentration (D) (mol/L) | Phosphite ion concentration (mol/L) | Chelating agent concentration (mol/L) | Appearance | Corrosion resistance (Hr) | 0.0431C + A/4 | 0.0431C + A/50 |
|---|---|---|---|---|---|---|---|---|
| Example 5 | 0.076<br>5 | 0.01 | 0.05 | 0.1 | Uniform Black | 240 | 0.023 | 0.0049 |
| Example 6 | 0.15<br>10 | 0.015 | 0.1 | 0.1 | Uniform Black | 240 | 0.026 | 0.0081 |
| Example 7 | 0.306<br>20 | 0.02 | 0.15 | 0.1 | Uniform Black | 168 | 0.033 | 0.015 |
| Example 8 | 0.076<br>5 | 0.01 | 0.15 | 0.1 | Uniform Black | 240 | 0.023 | 0.0049 |

What is claimed is:

1. A treatment solution for forming a black trivalent chromium chemical conversion coating film on zinc or zinc alloy, the solution comprising:

a trivalent chromium ion;

a chelating agent capable of forming a water soluble complex with the trivalent chromium ion;

a zinc ion;

an organic sulfur compound;

a phosphite ion; and wherein a zinc ion concentration C (mol/L), a trivalent chromium ion concentration A (mol/L), and a sulfur compound concentration D (mol/L) in the treatment solution are in a range represented by the following expression (1), $$0.0431C+A/4>D>0.0431C+A/50.$$

2. The treatment solution according to claim 1, wherein a zinc ion concentration C in the treatment solution is in the range of 0.002 to 0.45 mol/L.

3. The treatment solution according to claim 1, wherein a phosphite ion concentration in the treatment solution is in the range of 0.01 to 0.6 mol/L.

4. A method for forming a black trivalent chromium chemical conversion coating film on zinc or zinc alloy by using the treatment solution according to claim 1, the method comprising the step of setting a zinc ion concentration in the treatment solution at an initial stage (in an initial bath preparation) within the range of 0.002 to 0.15 mol/L, wherein the zinc ion concentration is controlled so as not to be out of the range of 0.002 to 0.15 mol/L.

5. A method for forming a black trivalent chromium chemical conversion coating film on zinc or zinc alloy, the method comprising the step of performing a chemical conversion treatment on zinc or zinc alloy by using the treatment solution according to claim 1, with the solution kept at a temperature of 10 to 60° C.

6. A metal coated with zinc or zinc alloy having a black trivalent chromium chemical conversion coating film formed by performing a chemical conversion treatment on the zinc or zinc alloy with the treatment solution according to claim 1.

* * * * *